US008616469B2

(12) United States Patent
Han

(10) Patent No.: US 8,616,469 B2
(45) Date of Patent: Dec. 31, 2013

(54) WATER-SAVING SHOWER HEAD WITH EXTENSION UTILIZING AIR-PRESSURE

(75) Inventor: Dae Suk Han, Hanam-si (KR)

(73) Assignee: Kosdo, Inc., Seoul (KR)

( * ) Notice: Subject to any disclaimer, the term of this patent is extended or adjusted under 35 U.S.C. 154(b) by 861 days.

(21) Appl. No.: 12/704,448

(22) Filed: Feb. 11, 2010

(65) Prior Publication Data

US 2010/0314468 A1 Dec. 16, 2010

Related U.S. Application Data

(63) Continuation-in-part of application No. PCT/KR2010/000440, filed on Jan. 22, 2010.

(30) Foreign Application Priority Data

| | | |
|---|---|---|
| Jun. 15, 2009 | (KR) | 10-2009-0052984 |
| Jun. 15, 2009 | (KR) | 10-2009-0052985 |
| Dec. 17, 2009 | (KR) | 10-2009-0126171 |
| Dec. 17, 2009 | (KR) | 10-2009-0126174 |

(51) Int. Cl.

| | |
|---|---|
| ***B05B 7/12*** | (2006.01) |
| ***B05B 1/30*** | (2006.01) |
| ***E03C 1/08*** | (2006.01) |
| ***F23D 11/16*** | (2006.01) |
| ***F23D 14/62*** | (2006.01) |

(52) U.S. Cl.
USPC ..... 239/428.5; 239/407; 239/419.5; 239/552; 239/569; 239/590.3

(58) Field of Classification Search
USPC ..... 239/311, 407, 419.5, 428.5, 552, 569, 239/590.3
See application file for complete search history.

(56) References Cited

U.S. PATENT DOCUMENTS

| | | | | |
|---|---|---|---|---|
| 4,134,548 | A | 1/1979 | Harmony | |
| 4,573,639 | A | 3/1986 | Logue | |
| 5,305,476 | A * | 4/1994 | Ohyama et al. | 4/605 |
| 6,182,703 | B1 | 2/2001 | Brice | |
| 6,260,273 | B1 | 7/2001 | Brice | |
| 7,866,572 | B2 * | 1/2011 | Ichige | 239/428.5 |
| 2007/0158470 | A1 * | 7/2007 | Taylor et al. | 239/428.5 |

FOREIGN PATENT DOCUMENTS

| | | |
|---|---|---|
| EP | 0 451 868 B1 | 11/1994 |
| JP | 04-197463 | 7/1992 |
| JP | 05-026151 | 4/1993 |
| JP | 06-209873 | 8/1994 |
| JP | 06-315654 | 11/1994 |

* cited by examiner

*Primary Examiner* — Ryan Reis
(74) *Attorney, Agent, or Firm* — Revolution IP, PLLC

(57) ABSTRACT

In the present invention, a new air-pressure utilizing water-saving shower head which takes in external air to increase the spray pressure is introduced. According to the present invention, this water-saving shower head comprises, a holding space for water inside, a body that contains an air hole at the bottom to take in the external air, the internal cross-sectional areas decreasing and then increasing, an air intake hole connecting into the air hole of the upper body, a pressure applying unit which mixes the external air coming through the air hole with the novelty of the pressure of the water flow movement, positioned at the front side of upper body and consists of an extended spray tube with multiple spray boards protruding outward.

10 Claims, 6 Drawing Sheets

WATER-SAVING SHOWER HEAD WITH EXTENSION UTILIZING AIR-PRESSURE

CROSS REFERENCE TO PRIOR APPLICATIONS

This application is a CIP Application of PCT International Patent Application No. PCT/KR2010/000440 filed on Jan. 22, 2010, which claims priority to Korean Patent Application Nos. 10-2009-0052984 filed on Jun. 15, 2009, 10-2009-0052985 filed on Jun. 15, 2009, 10-2009-0126171 filed on Dec. 17, 2009 and 10-2009-0126174 filed on Dec. 17, 2009, which are all hereby incorporated by reference in their entirety.

TECHNICAL FIELD

The present invention relates, in general, to a shower head, and more particularly, to a shower head in which the inflow of exterior air increases the spray pressure of water with an extension utilizing air-pressure to prevent atomized water spray even with high pressure.

BACKGROUND

In general, shower heads are cold or hot water spraying devices in the form of water-sprinklers that are widely used in bathrooms, sinks, and bathtubs in homes, or in commercial use, such as body showers, pools, water-softeners, or tubs.

These shower heads can be categorized as sit- or stand-up types and, depending on the type, the shapes may be varied.

The mode of operation of shower heads is that cold or hot water is introduced through the hose, and the water flows through the internal conduit of the head and is sprayed externally through a plurality of spray holes to enable the user to take a shower.

In the past, as the water pressure sprayed on the user was dependent on the water supply pressure, in a low-pressure water supply environment, the spray pressure was weak causing low efficiency of showers.

On the other hand, in a high-pressure water supply environment, the efficiency of showering increased but, due to increased water consumption, the cost posed problems.

Also, in the high-pressure environment, the atomization of water from rapid spray due to the increased spray pressure reduces the efficiency of showers.

DETAILED DESCRIPTION OF THE INVENTION

Technical Challenges

The present invention intends to overcome the challenges described, and the object of the invention is to provide a water-saving shower head with an extension spray arm protruding outward to prevent atomized spray at high pressure by providing gradual tapering to smaller internal conduits while increasing the spray pressure of the flowing water.

Solutions to the Problem

To achieve this object, a water-saving shower head with various parts is provided: a space holding the water internally, a body with an air hole positioned at the lower end to take in the external air, applying pressure on the inner body by decreasing and then increasing internal cross-sectional areas with an air intake hole connecting to the air hole of the body, enabling the mixture of external air to increase the water pressure, and, being positioned at the front side of the body, the shower head becomes a water-saving unit with the extension arm consisting of a plurality of spray boards and tubes utilizing air pressure.

According to one embodiment of the present invention, a plurality of penetration holes corresponding to the number of extension spray tubes are formed so that they can be assembled into the spray board externally and completed by the protection cover protruding externally.

In this embodiment, the protection cover may have a connecting hole at the center to enable the connection of the spray board and the body.

Furthermore, protection cover may have extra padding material, extending from the center toward the outer end.

According to an embodiment of the present invention, with the center (a) of the extension spray tube in the spray board and the center (b) of the penetration hole in the protection cover, moving from the center of the protection cover toward the outside, the center (b) can be positioned radially outward relative to the center (a).

According to an embodiment of the present invention, the air hole of the spray body may be equipped with a valve that prevents the reverse flow of the water in the internal conduit while allowing the intake of external air.

In this embodiment, the valve has a combining hole in the center, and on the outer periphery of the combining hole, there may be a cover with a plurality of air intake holes and a combining mechanism that connects to the combining holes in the cover, and may consist of wings made of carbon extending to the external side of the combining mechanism.

According to an embodiment of the present invention, the hose combining section connects to the water-supply connecting hose at the bottom of the body, and inside the hose connecting mechanism, there may be a plurality of padding parts protruding along the circumference.

Accordingly, the protruding sections corresponding to the plurality of padding parts corresponding to the number of the protection parts may be formed on the inside of the hose connection mechanism toward the direction of the periphery and, with a diameter narrower than that of the water supply, may comprise an adaptor enabling connection to the inside of the hose connection section.

In this embodiment, there may be multiple adaptors with various internal diameters enabling connection and disconnection, selectively.

According to an embodiment of the present invention, the body is long in the direction of the internal conduit that allows the water flow taken in through the pressure unit, and the internal conduit can be formed such that the cross-sectional areas taper smaller from the pressure unit toward the flow direction along the holding space.

In this embodiment, there may be an addition of a directional change assembly formed internally on the front side of the internal conduit of the body, to change the direction of the water taken into the holding space of the head through the internal conduit of the body.

Furthermore, to increase the speed of the water going into the holding space in the head, the cross-sectional areas of the internal conduit of the body may be shaped gradually decreasing in size.

ADVANTAGEOUS EFFECTS OF THE INVENTION

The present invention of a water-saving shower head equipped with an extension arm configuration, utilizing air pressure, has the following benefits:

First, due to the formation of an extended spray tube along the water spray holes protruding and extending outward, the pressure of the water supply is high enough to prevent the atomization of the water even if the speed of water spray increases.

Second, with the protection cover formed protruding outward on the spray board, there is an advantage of spraying the water to a wider area.

Third, by inserting the padding material from the center toward the exterior, there is an advantage of preventing damage to the spray board and the protection cover from the high water-supply pressure.

Fourth, the one-way valve in the air intake hole that takes in the outside air has the effect of allowing the outside air to come in, while preventing the water in the internal conduit from flowing backward.

Also, the one-way valve positioned in the air-intake hole reduces the noise level caused by the air being taken in through the hole.

Fifth, the configuration of the tapered-down internal conduit following the direction of water flow has the effect of increasing the pressure gradually before the water is sprayed, thereby increasing the spray pressure of the water.

Furthermore, as the cross-sectional area of the internal conduit gradually decreases, the mixing of the external air taken in and the water becomes more effective, increasing the pressure of the spray water.

Also, the directional control component positioned on the inside of the holding space in the head aligning the flow direction of the water with that of the water spray maintains the proper air pressure while the water is sprayed.

Sixth, having the padding material in the hose connection section which connects to the hose supplying the water increases the durability of the most vulnerable part in the head.

Seventh, the multiple adaptors with various internal diameters that are smaller than the water supply conduits have the capability of responding to conform with various water supply environments.

REFERENCE CHARACTERS ON THE MAIN PARTS OF THE FIGURES

Figure 1:
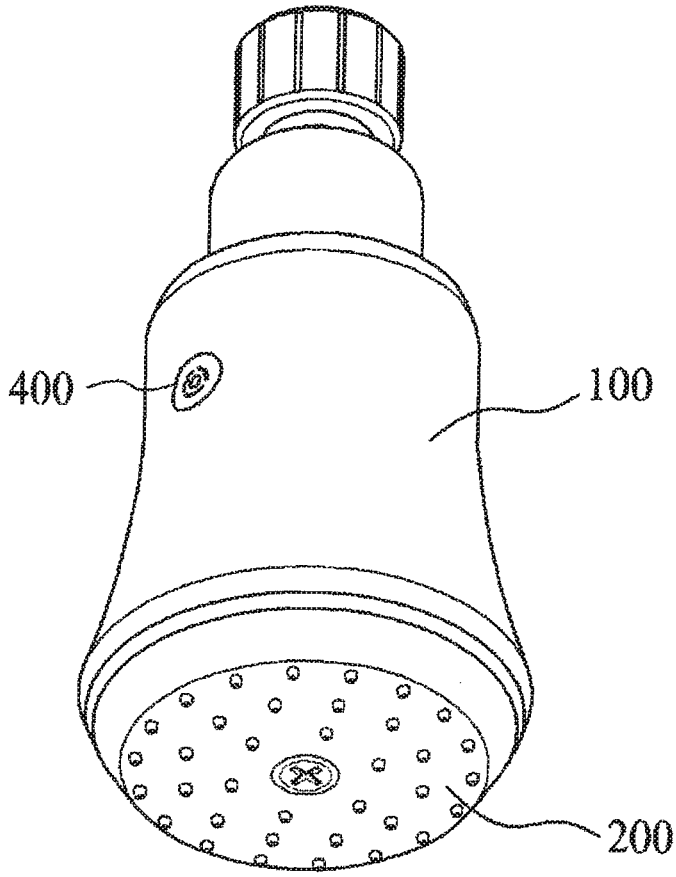
FIG. 1: Oblique view of the shower head according to one embodiment of the present invention

10, 100: Body, 12: Internal conduit
14, 140: Air hole, 200: Spray board
240: Protection cover, 248: Protection material
300: Pressure-applying unit, 326: Air intake hole
400: Valve, 500: Hose connection section
600: Adaptor

Preferred Embodiment Of The Present Invention

Below is the description of the present invention which can be best realized with reference to the attached drawings as practical examples. In describing the practical examples, the same names and same reference characters are used for the same configuration and additional explanation for these is omitted.

In this practical example, the term "shower head" refers here to a household device.

Figure 2:
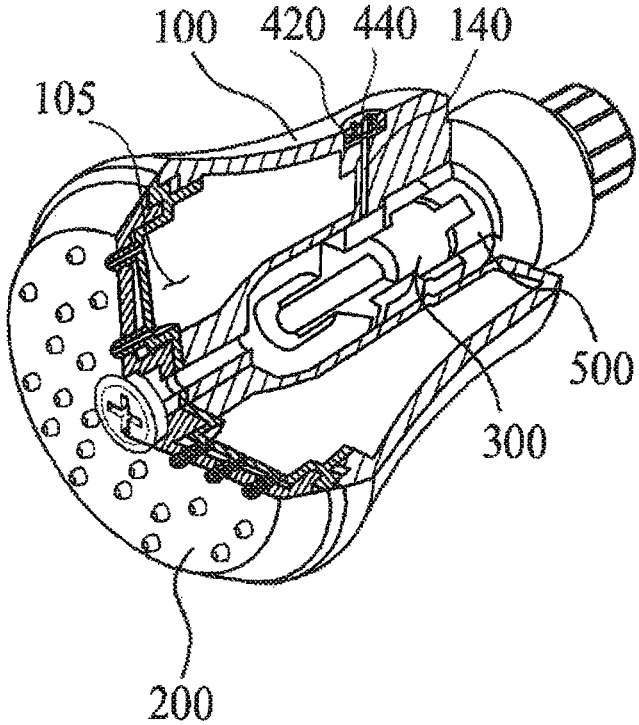
FIG. 2: View of internal parts of FIG. 1
Figure 3:
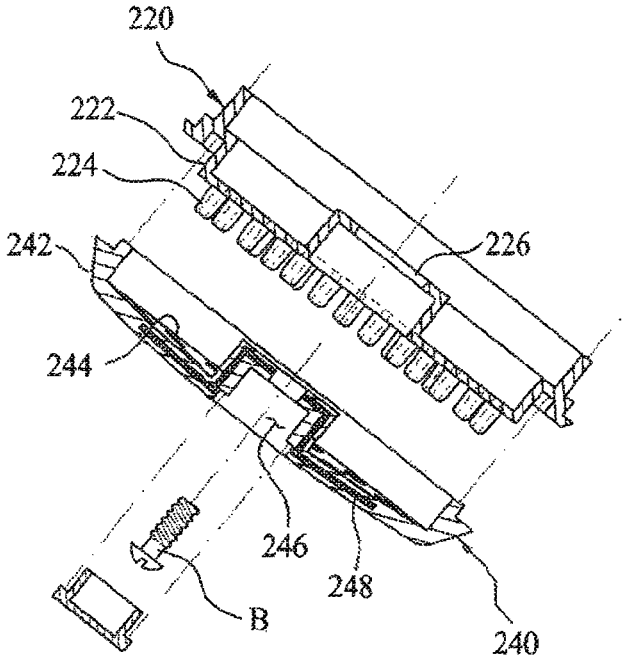
FIG. 3: Oblique view of the spray board according to the present invention
Figure 4:
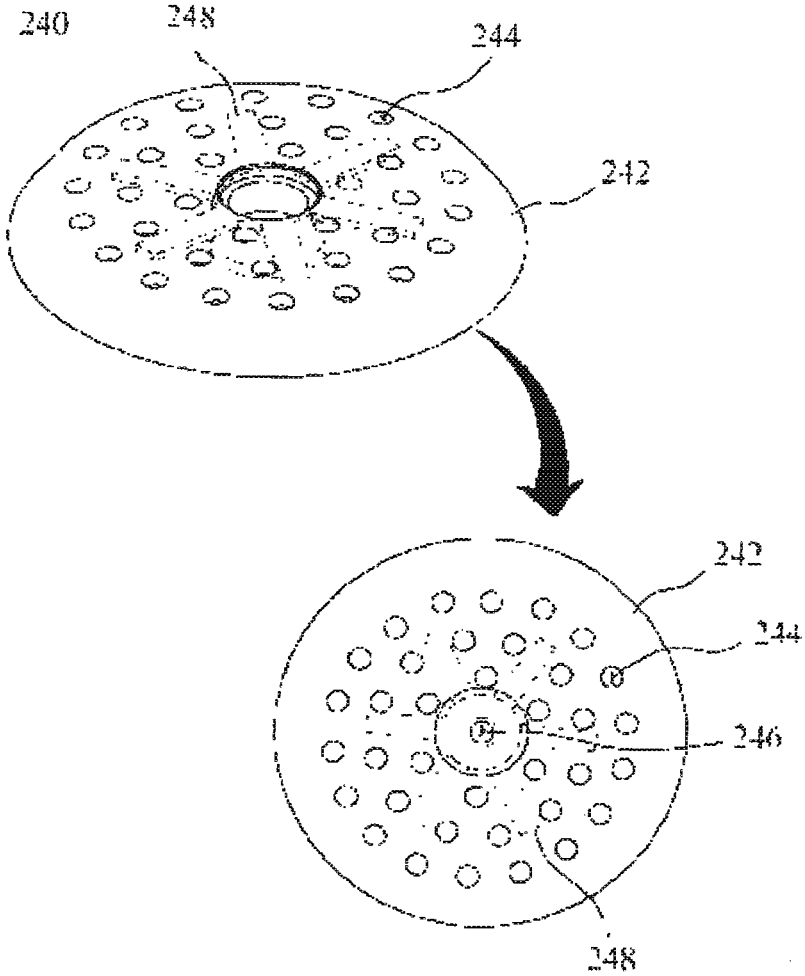
FIG. 4: View of protection cover based on the exemplary embodiment of the invention

An overall explanation of the shower head can be accomplished with FIG. 1 through 4. Here, FIG. 1 is an oblique view of a shower head of the present invention, FIG. 2 depicts the internal parts of FIG. 1, FIG. 3 is an oblique view of the spray board of this embodiment of the present invention, and FIG. 4 is a view of the protection cover based of the exemplary embodiment of the invention.

A shower head of this embodiment of the present invention refers to a standing type and consists of, as major parts, the body (100), the spray board (200), and the pressure-applying unit (300).

At the bottom of the body (100) is an air hole (140) which takes in the external air. Here, the air hole (140) is connected through the air intake hole (326) positioned on the pressure-applying unit, external air is mixed with the water in the pressure-applying unit (300) thus increasing the flowing pressure of the water. The theory of the air intake through the air hole (140) will be explained later.

The body (100) of the present invention has an internal holding space (105) which holds the water taken through the pressure-applying unit temporarily before being sprayed outward through the spray board (200).

The spray board (200) is positioned at the front side of the body (100) and the spray board (200) is extended and protruded to form multiple extended spray tubes (224) that connect through the holding space (105).

As the extended spray tube (224) protrudes outward, the pressure-applying unit (300) increases the flow pressure of the water and prevents atomization during the spraying process through the extended spray tube (224).

The pressure-applying unit (300) of the present invention is formed with internal cross-sectional areas with decreasing and increasing shapes and positions at the internal flow tube (120) on the upper body (100). Here, the air intake hole (326) which connects to the air hole (140) of body (100) mixes the external air that comes through the air intake hole (326) due to the difference in water flow pressure and increases the flow pressure of the flowing water.

The spray board (200) as depicted in FIG. 3 forms a center hole (226) that corresponds to the connecting teeth, and on the outside of the center hole (226), there are a plurality of extended spray tubes (224).

Therefore, the water is sprayed through the extended spray tubes (224) after passing through the holding space (105) which is formed by the combination of the body (100) and the spray board (200).

According to the present invention, there is a plurality of penetration holes (244) corresponding to the extended spray tubes (224) on the spray board (200) to enable attachment to the exterior of the spray board (200) corresponding to the outward protruding protection cover (240).

The protection cover (240) serves to prevent damage to the spray board (200) from the spray pressure of the water coming through the spray board (200) and the extended spray tubes (224).

As shown in FIG. 4, the protection cover (240) corresponds to the cover of outward protruding body (242), and the center hole (226) of the spray board (200) and consists of the connecting holes (246) on the center of the cover body (242) as well as multiple penetration holes (244) corresponding to the extended spray tubes (224) on the spray board (200).

Accordingly, the extended spray tube (224) of the spray board (200) is inserted in the penetration hole (244) of the protection cover (240), the connection teeth are locked in by a bolt (B) passing through the connecting hole (246) of the protection cover (240) and the center hole (226) of the spray board.

Also, as shown in FIG. 4, the protection cover (240) has heterogeneous material as the padding material inserted radially relative to the connecting hole (246) in the center.

To widely disperse the water through the extended spray tubes (224) of the spray board (200), the protection cover (240) protrudes outward.

Furthermore, assuming the center of the extended spray tube of the spray board "a", the center of penetration hole (244) of the protection cover "b", moving from the center of the protection cover (240) outward, as the center of "b" is positioned outside the radius against the center "a", the range of water spray through the extended spray tube (224) of the spray board (200) becomes wider.

Figure 5:
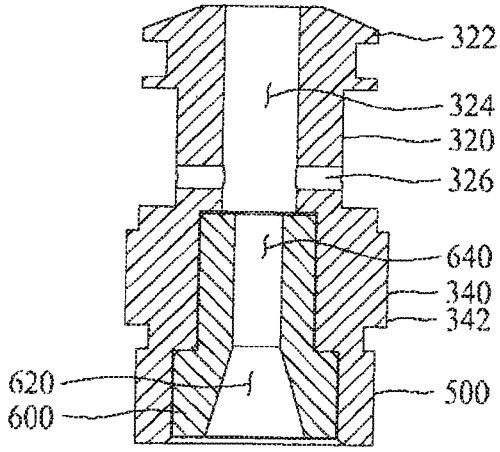
FIG. 5: Cross-sectional view of the pressure unit according to the present invention
Figure 6:
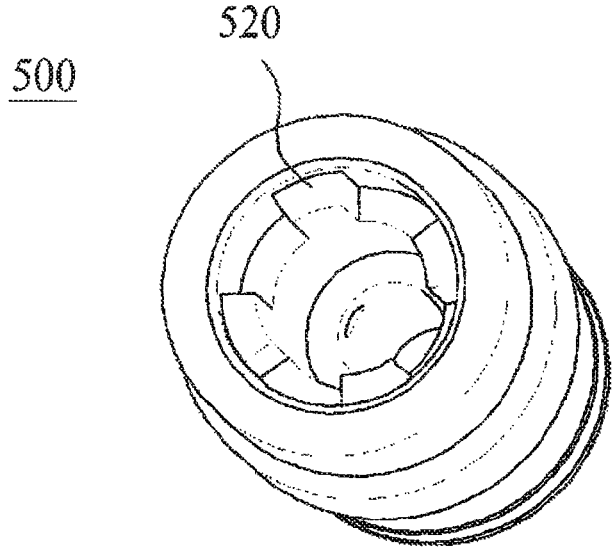
FIG. 6: Oblique view of the hose connection section according to the present invention
Figure 7:
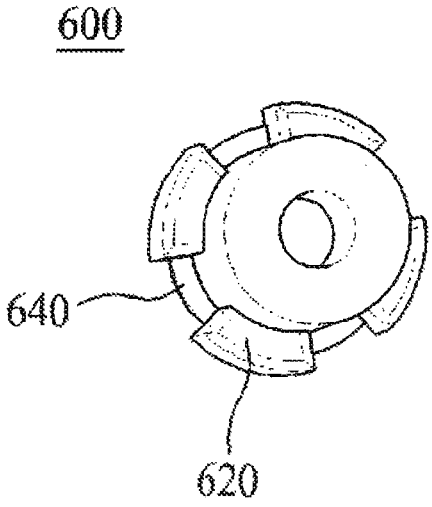
FIG. 7: Oblique view of the adaptor based on the exemplary embodiment of the invention
Figure 8:
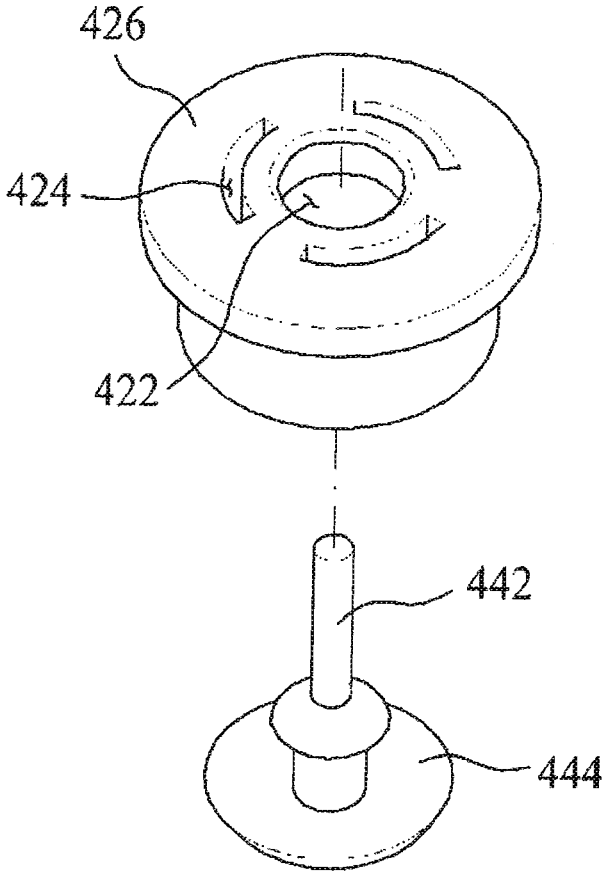
FIG. 8: Oblique view of the disassembled valve according to the present invention

Next, referring to FIG. 5 through 8, in this embodiment of the present invention, a pressure applying unit, an adaptor, and the valve can be described as follows: According to the present invention, FIG. 5 is a cross-sectional view of the pressure unit, FIG. 6 is an oblique view of the hose connection section, FIG. 7 is an oblique view of the adaptor, and FIG. 8 is an oblique view of the disassembled valve.

According to this embodiment of the present invention, upper pressure applying unit (300) consists of the housing (322, 342), the flow conduit (324) formed in the upper housing (322, 342), and the air intake hole (326) connecting into the air hole positioned in the upper body; and this assembly constructs a new flow conduit in the entrance section of the water supply and thus serves to vary the water flow pressure.

The flow conduit of the upper pressure-applying unit (300), in its large parts, consists of the water supply section (620) where the initial water enters, the flow tube (640) of which the internal cross-sectional area is smaller than the upper supply section (640), and the vent tube (324) of which internal the cross-sectional area is larger than the upper supply section (640).

Here, on the upper vent tube (324), an upper air intake hole (326) is formed, hence the pressure difference generated by the water passing through the upper flow tube (640) and the upper vent tube (324) enables the intake of the external air through the upper air intake hole (326), mixing with air to increase the water-supply pressure.

In other words, the water pressure taken in through the upper supply hole (620) increases as it passes the upper flow tube (640). Accordingly, as the highly pressurized water enters into the upper flow vent with expanded cross-sectional area, the pressure becomes lower than atmospheric pressure and induces the external air to come through the upper air intake hole (326).

According to this embodiment of the present invention, the housing (322, 342) of the upper pressure applying unit (300), as depicted in FIG. 5, forms an upper air intake hole (326) and consists of the first housing (322, 342) of the upper body (100) as a single unit which becomes the external wall of the upper flow tube and of the second housing (322, 342) which is adjacent the inner wall of the upper body (100).

Here, between the first housing (322, 342) and the second housing (322, 342), an air space is formed of which holds the external air which came through the air hole (140) of the upper body (100).

According to this embodiment of the present invention, at the bottom-most area, there is a hose connection section (500) which connects to the water supply hose and protrudes toward the outside of the upper body (100).

As depicted in FIG. 6, the upper hose connection section has multiple padding parts (500) installed in a radial pattern, and this reinforces the connected area which is the weakest part of the assembly.

The water supply pressures delivered to the shower head may vary vastly, depending on the surrounding environment. According to this embodiment of the present invention, to keep the supply pressures constant, there are multiple adaptors (600) available with various inner diameters that can be selectively inserted or taken out.

As depicted in FIG. 6, the upper adaptor (600) has an external protrusion (620) corresponding to the upper padding section formed on the upper hose connection section (500), from the upper hose connection, with a hooking mechanism (640) installed on the bottom for ejection.

By having the upper adaptor (600) connected to the upper hose connection (500), this replaces the supply hole (620) and the flow tube (640) of the upper pressure applying unit (300).

According to this embodiment of the present invention, the upper valve (400), as described earlier, has a connection hole (422) in the center, a plurality of air intake holes (424) around the upper connection hole (422) with a cover (426) connecting into the air hole (140) of the upper body (100) and connection teeth (442) corresponding to connection holes (422) of the upper cover (426) and consisting of the carbon wings (444) formed on the outside of the connection teeth (442).

As a result, as the upper valve (400) is connected into the air hole (140) of the upper body (100), this allows the inflow of external air but hinders the reverse flow of the water flowing in the upper inner flow tube (120).

Moreover, by connecting the upper valve (400) into the air hole (240) of the upper body (200), this also minimizes the noise generated by external air entering and passing through the air hole (240) of the upper body (200).

In other words, when the external air enters through the air hole (240) of the upper body (200), this generates noise but the cover (426) of the upper valve (400) primarily covers the air hole (240) damping the vibration and thus minimizing the noise.

Figure 9:
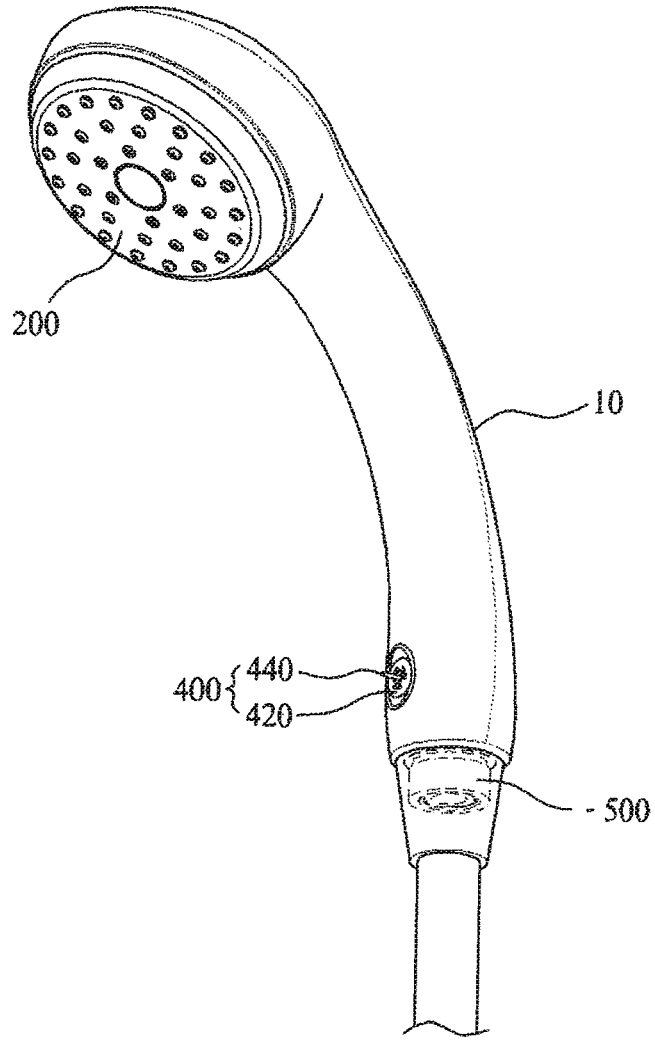
FIG. 9: Oblique view of the shower head according to the present invention

In conclusion, referring to FIG. 9 through 11, according to an embodiment of the present invention, the description regarding the shower head is as follows.

According to this embodiment of the present invention, the shower head considered is of the sit-down type, and as this is very similar in configuration to the stand-up type except for its shape, the detailed description will not be included here.

According to this embodiment of the present invention, the shower head consists of the spray board (200), the pressure applying unit (300), and the body (10) with the long inner inner flow conduit (12) that allows the water to flow to the upper holding space (105).

Here, the inner flow conduit (12) in the body (20) has gradually decreasing cross-sectional areas from the upper pressure applying unit (300) toward the holding space (105) which is the direction of the water flow, which increases the pressure of the water when it is flowing along the inner flow conduit (12) into the upper holding space (105) resulting in an increase of the spray pressure through the upper spray board (200) to the outside.

Also, at the bottom of the upper body, as described in the previous section, there is an air hole (14) to allow the external air to come in, and as the cross-sectional area of the upper inner flow tube (12) becomes smaller, the mixture of the external air through air hole (14) and water becomes more active causing the spray pressure of the water to increase.

Figure 10:
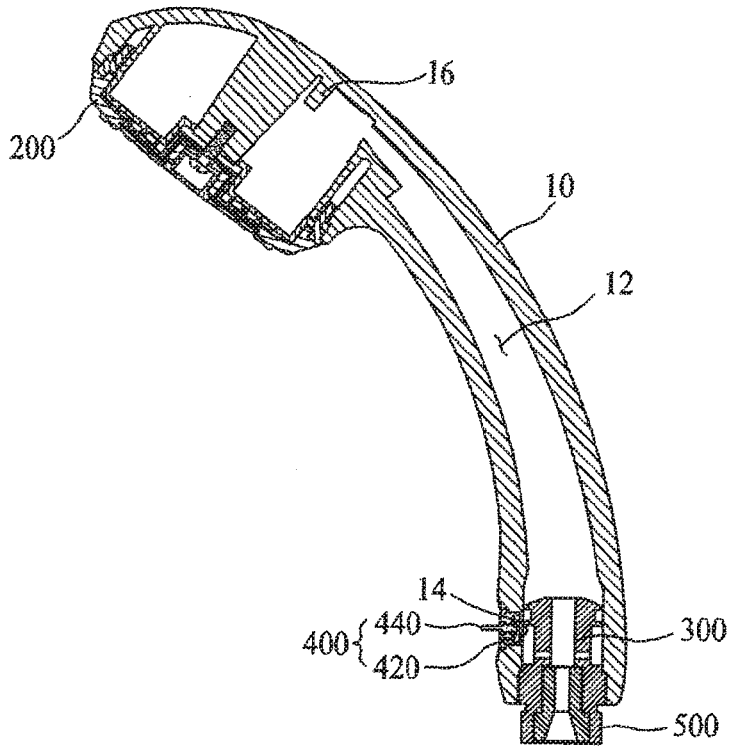
FIG. 10: Cross-sectional view of FIG. 9
Figure 11:
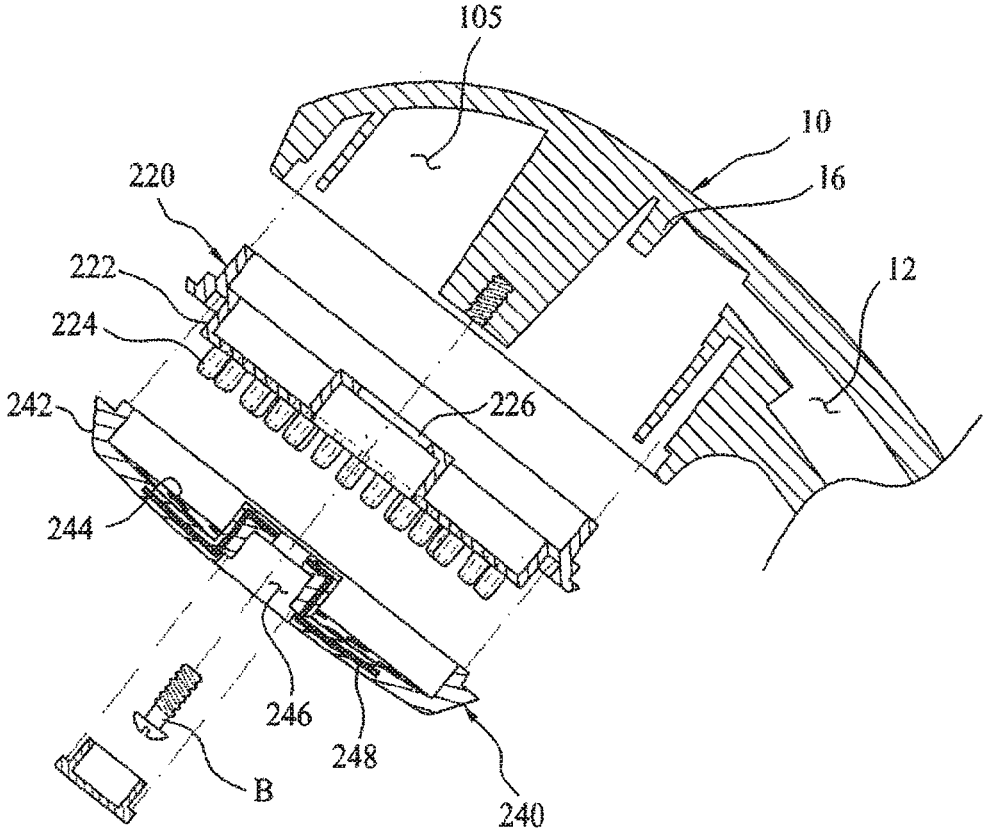
FIG. 11: Partial oblique view of the shower head based on FIG. 9

According to this embodiment of the present invention, as depicted in FIGS. 10 and 11, the upper holding space (105) and its adjacent front side of upper inner flow tube (12) are in the form of diminishing cross-sectional areas, which causes the water flow to increase its pressure and speed as it flows through the inner tube (12) and once again it increases its pressure and speed just before it enters the upper holding space (105).

According to this embodiment of the present invention, there is a direction change mechanism (16) in the upper holding space (105). The upper directional change mechanism (16) is in the form of a protrusion in front of the inner flow tube (12) of the upper body (10) and it directs the water flow which came through the inner flow tube (12) from the upper body (10) to the upper holding space (105) in the direction of the upper spray board (200).

Accordingly, in the process of spraying the water through a plurality of extended spray tubes (224), the pressure generated by the air taken in through the air hole (14) of the upper body (10) is delivered very efficiently.

The present invention is not limited to the exemplary embodiments of the invention, and as disclosed in the scope of patent application, a person skilled in the art of the patent can make modifications without exceeding the spirit of this invention and all this modification remains within the scope of this invention.

The invention claimed is:

1. A water-saving shower using an air pressure, which has a plurality of extended spray tubes, comprising;

a body having an internal holding space which is capable of containing water internally and an air hole formed at the bottom of the body through which an external air can enter;

a pressure applying unit positioned at an inner portion of the upper body having an internal cross-sectional area being decreased and then increased toward the bottom of the body comprising an air intake hole connected through the air hole of the body wherein a flow pressure increases by mixing an external air entered through the air intake hole due to a pressure difference of water movement; and a spray board positioned at the front side of the body having the plurality of extended spray tubes protruding outward by extended externally, wherein the air hole comprises a valve allowing the influx of the external air and preventing the reverse flow of the water flowing through an inner tube, the valve comprising i) a cover having a combining hole in the center of the cover and at least one or more air intake holes located on the outer periphery of the combining hole and ii) a carbon wing having a combining teeth, when assembled, being fastened into the combining hole of the cover and extended outward of the combining hole.

2. The water-saving shower in of claim 1, further comprising a protection cover having a plurality of penetration holes corresponding to the extended spray tubes in order connect to the exterior of the spray board, and protruded externally.

3. The water-saving shower of claim 2, wherein the protection cover has a connection hole connecting the spray board to the center of the protection cover.

4. The water-saving shower of claim 2, wherein the protection cover has an additional padding material extended to the outside of the center of the protection cover.

5. The water-saving shower of claim 2, wherein a center (b) of penetration holes in the protection cover is positioned relative to a center (a) of the extended spray tubes in the spray board according to the center of the protection cover toward the outside.

6. The water-saving shower of claim 1, further comprising:

a hose connecter connecting into a water supplying connection hose positioned at the bottom of the body; and a plurality of padding sections extruding radially along the circumference positioned inside of the hose connector.

7. The water-saving shower of claim 6, further comprising:

a protruding section corresponding to the plurality of padding sections positioned outside of the hose connector; and a plurality of adaptors having a different diameter respectively narrower than that of the hose connector and combining to the inside of the hose connector.

8. The water-saving shower of claim 1, wherein the body has inner flow conduits where the water can flow to the holding space, and wherein the inner flow conduits form longitudinally along the direction of the water movement and have a cross-sectional area tapering down from the pressure applying unit to the holding space.

9. The water-saving shower of claim 8, further comprising a direction control unit positioned at the front of the inner conduits protruding toward the inside of the holding space, and changing the direction of the water entering through the holding space.

10. The water-saving shower of claim 8, wherein the cross-sectional area, at the front end of the inner flow conduits, tapers down gradually, in order to increase the flow speed of water coming into the holding space.

* * * * *